US005599012A

United States Patent [19]

Rebeaud

[11] Patent Number: 5,599,012

[45] Date of Patent: Feb. 4, 1997

[54] DECELERATING SYSTEM FOR DECELERATING THE MOVEMENT OF SHEETS INTO THE DELIVERY STATION OF A SHEET FED PRESS

[75] Inventor: Jean-Claude Rebeaud, Le Mont, Switzerland

[73] Assignee: Bobst SA, Lausanne, Switzerland

[21] Appl. No.: 438,771

[22] Filed: May 11, 1995

[30] Foreign Application Priority Data

May 11, 1994 [CH] Switzerland ..... 01477/94

[51] Int. Cl.[6] ..... B65H 29/68

[52] U.S. Cl. ..... 271/182; 271/188

[58] Field of Search ..... 271/85, 182, 188

[56] References Cited

U.S. PATENT DOCUMENTS

| | | | |
|---|---|---|---|
| 2,829,890 | 4/1958 | Kury et al. | 271/182 |
| 3,507,489 | 4/1970 | Wilshin et al. | 271/182 |
| 5,060,928 | 10/1991 | Huschelrath | 271/188 |
| 5,249,793 | 10/1993 | Scheufler | 271/188 |

FOREIGN PATENT DOCUMENTS

| | | | |
|---|---|---|---|
| 464530 | 1/1992 | European Pat. Off. | 271/182 |
| 484653 | 5/1992 | European Pat. Off. | 271/182 |
| 406427 | 1/1910 | France . | |
| 1013665 | 8/1957 | Germany . | |
| 60-40371 | 3/1985 | Japan . | |

*Primary Examiner*—H. Grant Skaggs
*Attorney, Agent, or Firm*—Hill, Steadman & Simpson

[57] ABSTRACT

A decelerating device for decelerating movement of die cut sheets into the delivery station of a sheet fed die cutter wherein die cut sheets are rapidly pulled along a substantially horizontal path into the delivery station and are abruptly stopped at predetermined stopping points including a rear tablet underlying the path of travel of the die cut sheets and movable toward and way from the predetermined stopping point to provide support for the trailing edge of a sheet passing into the delivery station in accordance with the length of the sheet and a deceleration brush positionable in the path of movement of the sheet into the delivery station which deceleration brush is carried by a movable carriage also carrying the rear tablet. The brush is angularly adjustable relative to the path of movement of the sheet in dependence on the relative closeness of the brush and the tablet and such angular adjustment is automatically predetermined based on the position of the carriage relative to the predetermined stopping point.

7 Claims, 1 Drawing Sheet

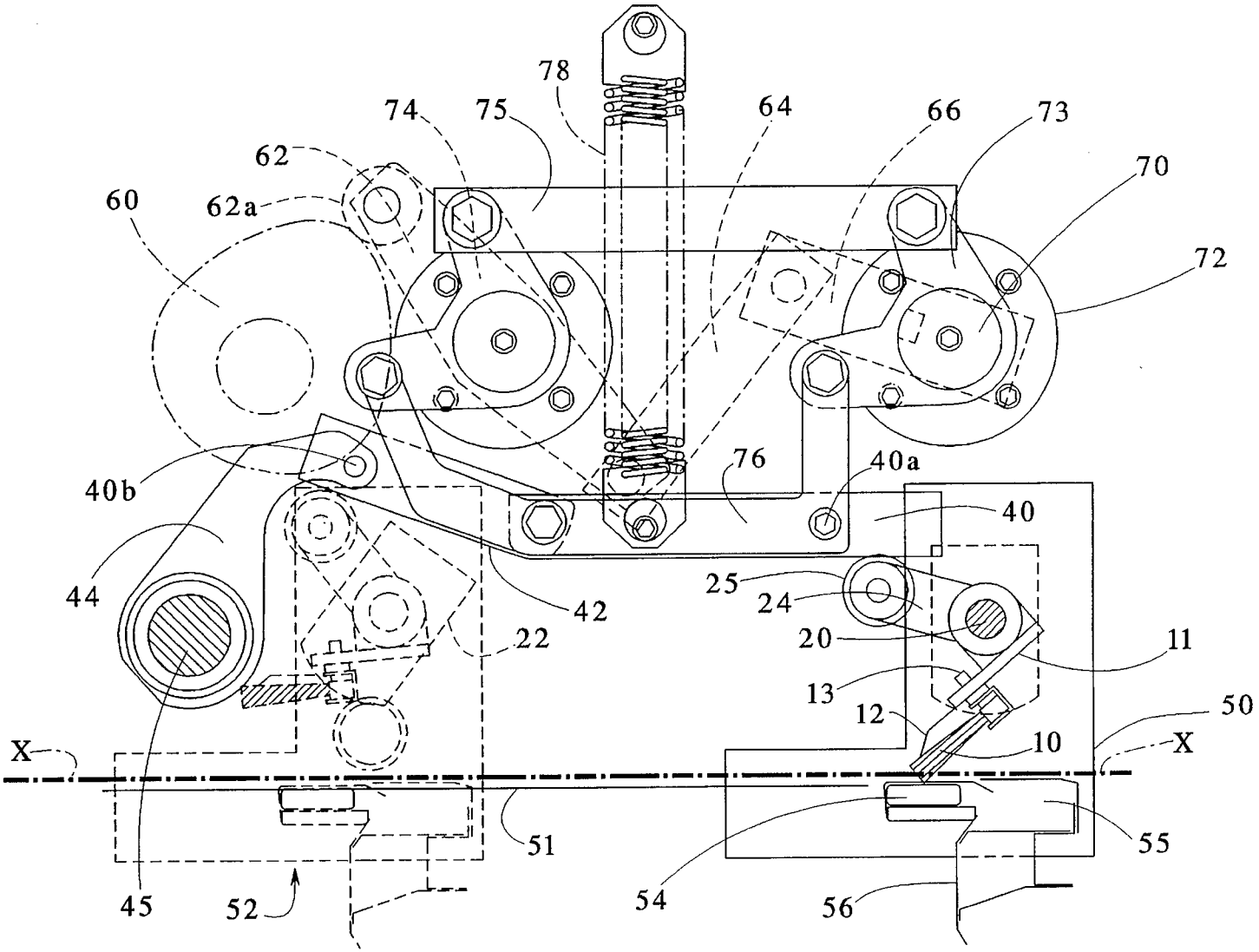
72
70
73
66
64
78
75
74
62
62a
60
40b
44
42
22
76
40a
40
25
24
20
11
13
12
10
50
X
55
56
54
51
52
45
X

DECELERATING SYSTEM FOR DECELERATING THE MOVEMENT OF SHEETS INTO THE DELIVERY STATION OF A SHEET FED PRESS

BACKGROUND OF THE INVENTION

1. Field of the Invention

The present invention relates to a decelerating system for decelerating the movement of sheets of paper or cardboard drawn into the delivery station of a sheet fed die cutting press.

2. Description of the Related Art

Die cutting presses are used for die cutting parts of paper or cardboard sheets which are fed through a die cutting press in rapid sequence so that the resulting die cut sheets can subsequently be formed into boxes and the like. Such sheet fed die cutting presses generally include an infeed station in which a pile of sheets is arranged with each sheet being successively taken from the top of the pile and carried onto a feed table. On this table each sheet is successively positioned against front lays and side guides prior to being seized on its leading edge by a series of grippers fitted along a crosswise gripper bar whose ends are attached to an endless train of lateral chains positioned on each side of the press and drawing the gripper bar and hence each sheet one-by-one through the press into the following processing stations. The processing stations generally include, in addition to the feed station and the feed table, the die cutting station, a waste stripping station, and a delivery station. The die cutting, of course takes place in the die cutting station and the die cut portions of each sheet have their waste removed in the waste stripping station and the finished die cut sheet is then delivered to the delivery station. At the delivery station, each sheet is released by the grippers on their respective gripper bars and the sheets are aligned and permitted to drop on top of a stack piling up on an outlet pallet.

In order to insure a uniform dropping and alignment of the sheets in the delivery station, the sheet should be as flat as possible once the sheet pulled into the delivery station is brought to a standstill when the grippers are opened. To this aim, when a sheet arrives in the delivery station, it is supported by a rear tablet at its trailing edge (and possibly by lateral tablets along its side) which may be retracted in order to let the sheet drop after it has come to a halt.

It will be understood that once a sheet has been die-cut and has had the waste portions of the sheet removed in the stripping station, the sheet may become quite frail and since it is drawn into the delivery station solely by the gripper bars gripping the leading edge of the sheet, the rapid deceleration of the gripper bar pulling the sheet into the delivery station may cause a curling or folding of the sheet.

In known die cutting presses, a decelerating device is utilized to create some friction on the die cut sheet as it moves into the delivery station and more particularly, such decelerating devices are known to consist of a long crosswise brush extending transversely of the press with its bristles directed downwardly and in contact with the sheet after the leading edge of the sheet has passed beneath it whereby the remaining part of the sheet is pinched slightly between the brush and the rear tablet so as to retard or decelerate movement of the trailing edge of the sheet.

In such systems, however, the brush has to be raised regularly in order to avoid shocks caused to the brush from successive passage of the gripper bars between the brush and the rear tablet.

The brush is generally arranged on a slanted crossbar directed in a downstream direction with regard to the traveling direction of the sheet, whose ends are fitted so as to pivot around an axis arranged proximate to the upper edge of the brush. A biasing means, for instance one or several spiral springs fitted on the axle are located in a drum geared with a plate that is shaped as a sector of a circle and as part of an axle, and this biasing means keeps this crossbar and, hence the brush, at rest in an upper position. The brush is then set in to action by the application of a contrary rotation which is achieved by downward pressure exerted on an upper slanted lateral arm which is also part of the same axle.

The force with which the brush contacts the sheet and "pinches" it between the brush and the rear tablet is preferably set according to the fragility of the sheet as a consequence of the particular die cutting action being performed. This force can be modulated either by adjusting the rigidity of the bristles (such as by reinforcing the bristles with a pressure blade) or else by adjusting the final positioning of the brush relative to the traveling plane of the sheet and hence the rear tablet.

Moreover, the position of the rear tablet must be adjusted according to the size of the sheet to be used for a given press run so that the axle of the crossbar upon which the decelerating brush is mounted is fitted on either side of the station in a lateral groove or grooves of the delivery station in order to allow the manual repositioning of the rear tablet as well as the brush. The means for applying pressure on the upper arm of the lever then consists of a horizontal ramp or guideway which is actuated with a vertical orthogonal translational movement, this ramp extending over the whole setting area of the tablet and of the brush.

The decelerating action of the brush serving to pinch the sheet between the brush and the rear tablet is desirably reduced as the size of the sheets being delivered to the delivery station is reduced (as the distance from the leading to the trailing edges of the sheet is reduced) either by acting on the pressure applied by the brush against the sheet or by some other means until it becomes unnecessary to provide any particular decelerating forces to the sheets for very small sizes of sheet.

Manual settings of the brush and the rear tablet to accommodate sheets of different length from their leading to their trailing edges are time consuming and considerably increase machine down-time from one run to another run in which different sized sheets are die cut.

SUMMARY OF THE INVENTION

It is an aim of the present invention to provide an improved decelerating device for decelerating the movement of die cut sheets into the delivery station of a sheet fed die cutter wherein die cut sheets are rapidly pulled along a substantially horizontal path into the delivery station of a die cutting press and then are abruptly stopped at a predetermined stopping point and released at their leading edges to permit them to fall in succession into a vertical pile of die cut sheets.

More particularly, it is an aim of the present invention to provide such a decelerating system whereby position setting of the sheet decelerating means will require little manual intervention once the rear tablet of the delivery station has been adjusted to accommodate various sized sheets.

More particularly, the decelerating device includes a sheet movement retarding means (which may constitute a slanting brush extending crosswise of the delivery station and oriented downwardly into the path of movement of a sheet into the delivery station) which is pivoted so as to pivot about the axle positioned above the path of movement of the sheet and which is designed to be raised intermittently by a spring biasing means during passage of a gripper bar beneath it and lowered immediately thereafter toward the path of travel of the sheet. For large sheets, the vertical descent of the sheet movement retarding means (or brush ) is determined by the configuration of a guideway into which an arm connected to the axle of the sheet movement retarding means is connected in order to force the brush into contact with the sheet forcing it into engagement with the rear tablet.

The guideway may be designed on the same movable carriage the brush and the rear tablet are mounted such that the descent of the brush remains constant for sheet sizes having a length between their leading and trailing edges up to some predetermined dimension and such that for sheets of shorter length, the pressure of the brush on the sheet is reduced or completely non-existent. For very short length sheets, the guideway may be so designed as to cause the sheet movement retarding means to make no contact with the sheet. In any case, movement of the carriage to effect a positioning of the rear tablet will effect a positioning of the brush.

The guideway may be designed so that the reduction of the pressure of the brush or other sheet movement retarding means is linear relative to the length of the sheet from its leading to its trailing edge or may be designed having the shape of an arc of a of a circle or following some sinusoidal or logarithmic curve depending on what relationships are desired between the length of the processed sheets and the desired pressures to be applied by the brush against such sheets. It may also be designed so that for given lengths of sheet, brush pressure is constant.

In a particularly useful embodiment of the invention, the slanted part of the ramp or guideway is fitted, though able to rotate, between the downstream end of a rectilinear part of the guideway and the upper end of a vertical supporting rod whose other end is rotatable movement on an axle. The lowering arm of the brush is positioned such that it cannot leave the guideway and the effect of the slanted part of the guideway can be readapted according to the dimension of the vertical supporting rod.

In a particularly advantageous embodiment of the invention, the axle of the brush is mounted in the same frame or carriage as is the tablet and this carriage is movable such that movement of the tablet necessarily involves a movement of the brush in an upstream and downstream direction within the delivery station in dependence on the length of the sheets to be processed in the delivery station.

BRIEF DESCRIPTION OF THE DRAWING

The FIGURE is a side view of a decelerating device according to the present invention.

DESCRIPTION OF THE PREFERRED EMBODIMENT

The invention will be better understood from a review of the FIGURE which illustrates some of the operating mechanism contained within the delivery station of a sheet fed die cutting machine wherein some parts are shown in vertical sections and others in side elevation and which illustrates these parts from the operator's side of the machine with the upstream end of the delivery station being pictured at the right of this FIGURE and the downstream end of the delivery station being pictured at the left side of this FIGURE.

As represented in this FIGURE, a sheet of paper or cardboard is pulled into the delivery station from the upstream end of that station (on the right) by sets of grippers mounted on a gripper bar extending transversely of the delivery station and the sheet arrives in the delivery station along a plane X—X as shown in the drawing. As is well understood by those skilled in this art, the gripper bars are rapidly moved from one station to another and momentarily stopped at each station to permit the desired die cutting, stripping, and sheet delivery to take place at each station. This invention is directed to a means for decelerating the movement of a sheet into the delivery station when the already die cut and stripped sheet (which is in a flail or weakened condition as a consequence of the die cutting and stripping) is abruptly stopped. If the die cut sheet is extremely flail and the gripper bar with its grippers contacting the leading edge of the die cut and stripped sheet is abruptly stopped, the sheet would have a tendency to pile up or curl in the delivery station as a consequence of this abrupt stoppage. To prevent such action, means are provided to contact the sheet after the gripper bar and associated grippers have passed into the delivery station to provide some frictional forces tending to decelerate the trailing edge of the sheet and these frictional forces may be provided by pressing the trailing edge of the sheet between a brush and a so-called rear tablet (supporting the trailing edge of the die cut and stripped sheet in the delivery station at least momentarily).

In the instant invention, the rear tablet 54 is retractable inside a carriage including a housing 55 and a rear lay 56. In order to insure that the trailing edge of a die cut and stripped sheet will rest on the rear tablet 54, it is necessary, when changing from one run to another (wherein the sizes of the sheets to be processed are different from the earlier one) to provide a means whereby the rear tablet 54 and the rear lay 56 will be positioned at the downstream edge of the sheet once the sheet is at a standstill and ready to be dropped on top of the outlet pile. The rear tablet 54 and rear lay 56 as well as the housing part 55 are carried in an assembly or carriage which is slidable in an upstream and downstream direction within the delivery station along a groove 51 shown diagrammatically in the drawing. The positions of the rear tablet 54, rear lay 56, and housing part 55 are shown in their fowardmost (or most downstream position) in dotted lines in this FIGURE and in that position, they are adapted to accommodate the shortest (from leading edge to trailing edge) sheets which the machine is able to process.

In the embodiment of the invention illustrated in the drawing, the sheet movement retarding means is shown as comprising a brush 10 which is oriented with its bristles slanted in a downward and downstream direction and with its bristles fitted along a crossbar 11 extending transversely of the die cutting machine. A pressure blade (12) is shown as being mounted on the crossbar 11 and as contacting the bristles of the brush 10 so as to provide a means for insuring additional pressure of the bristles on a sheet passing along the plane X—X. Fastening means such as bolts 13 are arranged at regular intervals along the crossbar 11 and permit the placement of a blade 12 on the crossbar and/or the adjustment of the position of that blade on the bristles for the purpose of permitting adjustment of the forces to be applied by the bristles of the brush against the sheet passing into the delivery station. Adjustment of these bolts 13 also will permit raising or lowering the brush relative to the plane X—X along which a die cut and stripped sheet passes into the delivery station. In this manner, the height of the brush and the force with which the bristles contact the sheet can be adjusted.

The crossbar 11 is carried on an axle 20 which, in turn, is fitted at each of its ends to the same movable frame 50 as is the tablet 54. This axle may also be replaced, if desired, by two half axles existing only at the ends of the crossbar but the net result is the same. Rotation of the axle 20 can then effect rotation of the brush 10 relative to the plane X—X so as to raise or lower the brush relative to that plane.

A spring biased member 22 is shown schematically in the drawings and is utilized to spring-bias the crossbar 11 and consequently the brush into an upper or raised position relative to the plane X—X. This means 22 may, for instance, include a plate which is secured to the axle 20 and which has on its lower curved surface a toothed circular section gearing in a drum which contains a spiral spring whose outer end is connected to the drum and whose inner end is connected to the central rotation axle.

The axle 20 is connected at one of its ends to a guideway follower arm 24 which is oriented upward and downstream of the axle 20 and which is provided at its end with a roller 25 which rests on a ramp 40. As a consequence, the vertical translational descent of the ramp 40 leads to a rotation of the brush 10 about the axis of axle 20 which lowers the brush into the plane X—X to cause the brush to contact a sheet passing into the delivery station and to thereby effectively pinch it between the brush and the rear tablet 54 so as to effect its deceleration. The ramp 40 has a horizontally extending portion and as long as the tablet 54, brush 10 and crossbar are moved forwardly and rearwardly to a certain extent, the relative position of the brush relative to the plane X—X will be identical.

More specifically, the ramp or guideway 40 has an upwardly extending section or slanted ramp 42 at its downstream end and this guideway is carried at its ends by rotation axles at the upstream end of the horizontal guideway 40 and at the downstream end of the upwardly extending guideway **40*a* and 40*b*, respectively. Axle 40*b* is in turn supported on an arm 44 which is itself movable around a horizontally extending axle 45. The guideway 40 is itself maintained by two lateral fixtures 76 which are connected to the device for controlling the vertical movement of the guideway 40, 42. The device for controlling the vertical movement of the guideway 40 includes a cam 60 (shown in dotted lines) which is connected to the drive of the machine itself (and whose movement is synchronized with movement of the gripper bars) and whose position determines the position of a scanning lever 62 containing a cam roller 62*a* which rides along the surface of the cam 60. The other branch of the lever 62 is situated opposite to the first one with regard to its central rotation point and is connected to a pull handle 64 acting on a rotation bar 66 which actuates a horizontal axle 70 transversing the lateral wall of the delivery station and mounted at its ends in bearings such as that identified at 72. A first upstream angular lever 73 is fitted on this axle 70 and is connected to a second downstream angular lever 74 by means of synchronization link 75 fitted at its ends onto the respective upper branches 73, 74. The two lower branches of the same members 73, 74 support the lateral fixtures 76 of the guideway 40 and are connected therewith by rotatable links. The member 74 is also fitted on an axle held in the lateral wall of the station by a bearing as is the case with member 73**.

A tension spring is connected at one end to the guideway 40 and its upper end to a fixed point of the delivery station.

In operation, the decelerating device works as follows:

As the cam 60 rotates, its rotation is followed by the roller **62*a* and will cause the lever 62 to move in a clockwise rotation to effectuate a lowering of the pull link 64 and hence link 66, which action involves a simultaneous counter-clockwise rotation of the angular levers 73, 74. This rotation lowers the fixture 76 and hence causes the ramp or guideway 40 to descend in a vertical translation. This descent of the guideway leads to a counter-clockwise rotation of the arm 24 and of the crossbar 11 lowering the brush 10 into position for sheet deceleration and, in fact, when a sheet is in place beneath the brush 10, for lowering the brush into contact with the sheet to effectively pinch the sheet between the brush and the rear tablet 54. This descent of the ramp or guideway 40 is achieved against the biasing force of spring 78** which extends itself during the descent of the guideway.

Contrarily, when the upper point of cam 60 moves away from the roller **62*a* on the end of scanning lever 62, the tension spring 78 will cause the guideway 40 to rise and the rise of this guideway affects a simultaneous rise of the brush 10 as the axle 20 rotates. As long as the movable frame 50 is positioned forward or rearward so that the roll 25 remains in contact with the horizontally extending portion of the guideway 40** (that is for long and medium sized sheets) the extent of the lowering of the brush remains constant.

On the other hand, and more specifically according to the invention, as soon as the length of the sheet size becomes smaller (the length being measured from the leading to the trailing edge of the sheet) the corresponding forward movement of the movable frame 50 makes the roll 25 move into contact with the upstream portion of the slanted ramp 42. Accordingly, the geometry of the cam 60 remaining constant, the push of the roll from a point initially higher makes the brush come in contact with the sheet during a shorter period and with a point not as low as when the roll is in contact with the horizontally extending portion of the guideway. The duration and intensity of the sheet deceleration are then automatically reduced for such smaller sized sheets based on a positioning of the rear tablet mounted carriage which is positioned to accommodate such sheets. The deceleration and intensity are reduced as the movable frame 50 is advanced toward the downstream end of the delivery station in accordance with the corresponding shorter sizes of sheets. At its extreme limit, when the carriage 50 reaches its downstream-most position 52 (as illustrated in dotted lines) the rotation of the brush 10 around its axle 20 is almost cancelled or is completely cancelled, the roller 25 remaining below the upper end of the slanted guideway or ramp 42. Thus, deceleration of the sheet has effectively been cancelled for very short sheet sizes.

It is important to understand that in a sheet fed die cutting machine, the abrupt starting and stopping of the gripper bars and consequently the sheets pulled through the machine creates a situation in which, for relatively large sheets, without any decelerating device in the delivery station, the die cut and already stripped sheets would tend to pile up or curl in the delivery station. The system disclosed herein which provides for sheet deceleration, is designed so that the deceleration means is automatically adjusted by a simple setting of the rear tablet 52 in relation to the length of sheet to be processed owing to the movement of the movable frame along its supporting groove 51. The movement of the frame carrying the rear tablet 54, the axle 20, and crossbar 11 as well as the brush 10 may be motorized and, if so, the setting into operation of the sheet retardation means in the delivery station is achieved particularly quickly and automatically, In principal, the system is designed so that the rear tablet 54, the crossbar 11 with its associated brushes 10, and the axle 20 are all mounted in a common carriage which carriage is slidable forwardly and rearwardly within the delivery station from the right extreme position shown in the drawing in full lines to the left extreme position shown in dotted lines at the left side of the drawing. As explained herein, the crossbar and its associated brush 10 is biased into position such as that shown in dotted lines (and regardless of where the carriage is located in the delivery station) so that the brush is out of contact with the gripper bar and gripped sheet pulled into the delivery station along the plane X—X. Immediately after the gripper bar has passed beneath the brush 10, the cam 60 rotates to a position such as that shown in dotted lines in the drawing forcing the ramp or guideway 40 downwardly and thereby causing the link 24 to rotate the crossbar 11 and the associated brush into the position shown in full lines in the drawing wherein the brush will contact a sheet being pulled into the delivery station and effectively pinch that sheet between the brush and the rear tablet 54 thus effectively preventing that sheet from buckling or folding upon itself when the gripper bar is abruptly stopped at a predetermined stopping point. Thereafter, when the grippers on the gripper bar release the sheet and commence movement again, the cam 60 will rotate to a position such that a lower part of its lobe is in contact with the roller 62*a* and the tension spring 78 will then cause the ramp or guideway 40 to move upwardly thereby permitting the spring biased cross bar 11 and associated brush to rotate upwardly to a position such as that shown in dotted lines at the left-hand side of the drawing to permit the passage of the next gripper bar and grippers and associated sheets into the delivery station.

By mounting the crossbar 11 and associated brush 10 as well as the axle 20 and the rear tablet 54 on a common carriage slidable along a groove 51, adjustment of the rear tablet 54 to accommodate sheets of varying length for different runs will also move the sheet movement retarding means or brush 10 along with it. It will be observed that the left-hand end of the ramp or guideway 40 is angled upwardly with the result that for shorter length sheets, a lesser pressure will be applied by the brush to the trailing end of a sheet and can be designed so that for very short length sheets, no brush pressure is applied at all.

Although various modifications may be suggested by those versed in this art, it should be understood that I wish to embody within the scope of the patent granted hereon all such modifications as reasonably and properly come within the scope of my contribution to the art.

What is claimed:

1. A decelerating device for decelerating the movement of die cut sheets into the delivery station of a sheet fed die cutter wherein die cut sheets are rapidly pulled along a substantially horizontal path into the delivery station of a die cutting press and then are abruptly stopped at a predetermined stopping point and released at their leading edges to permit them to fall in succession into a vertical pile of die cut sheets, the improvement which comprises a rear tablet underlying the path of travel of the die cut sheets and movable toward and away from said predetermined stopping point to provide support for the trailing edge of a sheet passing into the delivery station in accordance with the length of the sheet, a sheet movement retarding means positionable in the path of movement of a sheet into said delivery station, means carrying both said sheet movement retarding means and said rear tablet and movable toward and away from said predetermined stopping point in dependence on the length of sheets to be fed to said delivery station, and means adjusting the angle of said sheet movement retarding means relative to the path of said sheet in dependence on the relative closeness of said brush and tablet to said predetermined stopping position.

2. A decelerating device constructed in accordance with claim 1 wherein said sheet movement retarding means comprises a flexible brush.

3. A decelerating device constructed in accordance with claim 2 wherein said brush has a width substantially corresponding to the width of a sheet to be processed and which is positionable at variable angles to the path of movement of a sheet.

4. A decelerating device constructed in accordance with claim 3, wherein the setting of the rear tablet position to accommodate a particular length of sheet predetermines the angle of the brush relative to the path of movement of the sheet.

5. A decelerating device constructed in accordance with claim 4 wherein said brush is positionable at lesser angles for short lengths of sheets to provide smaller decelerating forces for such shorter sheets.

6. A decelerating device constructed in accordance with claim 1 including means for moving said brush into and out of the path of movement of sheets during each sheet movement cycle to permit the leading edge of each successive sheet and the means pulling said sheet into the delivery station to pass into said station unimpeded by contact with said sheet movement retarding means.

7. A decelerating device for decelerating movement of die cut sheets into the delivery station of a sheet fed die cutter wherein die cut sheets are rapidly pulled along a substantially horizontal path into the delivery station of a die cutting press and are then abruptly stopped at a predetermined stopping point and released at their leading edges to permit them to fall in succession into a vertical pile of die cut sheets, the improvement which comprises a movable carriage mounted within said delivery station and movable toward and way from said predetermined stopping point along a substantially horizontal plane, a rear tablet mounted on said carriage and positionable by movement of said carriage to provide support for the trailing edge of a sheet passing into the delivery station in accordance with the length of a sheet, a deceleration brush mounted on said carriage and rotatably positionable in the path of movement of a sheet into said delivery station, means determining the angle of said brush relative to the path of movement of a sheet passing into the delivery station in dependence on the relative closeness of said carriage to said predetermined stopping position, and means for intermittently raising said brush out of the path of movement of said sheet to permit the passage of a sheet between said brush and said rear tablet as a sheet is drawn into said delivery station.

* * * * *